US006102192A

United States Patent [19]

Tomuro et al.

[11] Patent Number: 6,102,192

[45] Date of Patent: Aug. 15, 2000

[54] ARTICLE PUSHING DEVICE

[75] Inventors: Toshimasa Tomuro, Tokyo; Yoshikata Muguruma, Kanagawa, both of Japan

[73] Assignee: Sunco Spring Co., Ltd., Kanagawa, Japan

[21] Appl. No.: 08/881,187

[22] Filed: Jun. 24, 1997

[30] Foreign Application Priority Data

Jul. 4, 1996 [JP] Japan ..... 8-174518

[51] Int. Cl.[7] ..... B65G 25/04

[52] U.S. Cl. ..... 198/747; 211/54.1

[58] Field of Search ..... 198/736, 747; 211/51, 54.1, 59.3, 123; 312/61, 71; 267/165

[56] References Cited

U.S. PATENT DOCUMENTS

| | | | |
|---|---|---|---|
| 3,366,119 | 1/1968 | O'Connor | 211/54.1 |
| 4,588,093 | 5/1986 | Field | 267/165 |
| 5,641,077 | 6/1997 | Tufano et al. | 211/54.1 |
| 5,906,283 | 5/1999 | Kump et al. | 312/71 |

FOREIGN PATENT DOCUMENTS

| | | |
|---|---|---|
| 60-18123 | 6/1985 | Japan . |
| 965956 | 3/1997 | Japan . |

*Primary Examiner*—Joseph E. Valenza
*Attorney, Agent, or Firm*—Jordan and Hamburg LLP

[57] ABSTRACT

The present invention provides an article pushing device for pushing an array of hanging articles along a hook bar by the action of self-restoring force of a compression spring body which can be elastically compressed with no space loss and be easily fitted on a hook bar without previously taking off the articles. The device comprises a zigzag leaf-spring body having a series of sharp alternate turns forming peaks and bottoms, which spring body can be contracted with substantially no space between neighboring parallel leaf-portions and has a series of notches (sliding holes with an open slit) made in peaks thereof for externally fitting onto the hook bar. The zigzag leaf-spring body is provided with a pushing portion at its front end and a holding member at its rear end. The holding member has an open slit for firmly fitting on the hook bar to hold the zigzag leaf-spring body which slidably fitted the same hook bar to push by its front pushing end an array of articles by the effect of the self-restoring force of the leaf-spring.

5 Claims, 8 Drawing Sheets

ARTICLE PUSHING DEVICE

BACKGROUND OF THE INVENTION

A prior art pushing device for pushing forward a line of blister-packaged articles by using spring force of reversed U-formed leaf-spring is disclosed in Japanese Utility Model Publication (JIKKOU SHOU) No. 60-18123. This pushing device is designed for pushing forward blister-packaged article suspended in line but involves the following disadvantages: This device has only one bending point and, therefore, may be overloaded thereat, loosing self-restoring force. In addition, the device is so large not to be easily used.

To solve the above-mentioned problem involved in the prior art device, the present applicant previously proposed, in Japanese patent application No. 7-145197 (hereinafter referred to as the previous application), a compact elastic type pushing device capable of working with a reduced load on its bent portions, which is an elastically bent (zigzag) type compression spring plate that is removably fitted on a hook bar to push forward a queue of articles slidably hanging from the hook bar by transmitting self-restoring force thereto through its front pushing end.

The hanging article pushing device of the previous application, however, has following problems:

(1) There are two differently formed pushing devices which are used on a single hook bar and a double hook bar respectively and can not be commonly used.

(2) The pushing device can be compressed with the zigzagged spring plate not to be tightly contracted (causing needless air gaps) and, therefore, can not satisfy users' desire to hang more quantity of articles on the hook bar.

(3) The pushing device can not be fitted on the hook bar without previously removing articles therefrom.

(4) The pushing end of the pushing device may be deformed resulting in insufficient movements of articles along the hook bar.

SUMMARY OF THE INVENTION

The present invention relates to a pushing device for feeding forward hanging articles and more particularly to a pushing device which is capable of automatically pushing forward a queue of articles hanging from a hook bar or aligned in an open display case so that the articles may be easily observed and taken out by customers.

An article pushing device according to the present invention is free from the above-mentioned problems involved in the prior arts and can be used in common on two or more kinds of hook bars (e.g., single and double hook bars for hanging the articles for sale), which is light and tough enough to be elastically contracted to its minimal length (i.e., a maximally reduced internal spacing) accumulating a suitable restoring force extending over its stroke and which can apply its self-restoring force through its pushing end to a line of hanging articles forward when fitted on the hook bar in such a way that the articles may be smoothly and effectively pushed forward along the hook bar every time when a leading article is removed therefrom. This device can be adjusted in its self-restoring force and stably fitted on the hook bar in accordance with the number of articles to be pushed. It can be easily fitted on and removed from the hook bar with no need of previously taking off the hanging articles. Accordingly, the present invention has the following objects (1) to (7):

(1) An object of the present invention is to provide an article pushing device comprising a zigzag leaf-spring, which has a series of notches in the axial direction of acting its self-restoring force and is slidably fitted at its notches onto an axis to be set (e.g., a hook bar) for applying a pushing force to a line of articles hanging from the hook bar by transmitting thereto an elastic self-restoring force through its one end.

(2) Another object of the present invention is to provide an article pushing device as mentioned above in item (1), which is characterized in that it has at least one series of the notches cut in the upper bent portions for fitting onto an axis to be set (e.g., hook bar) without impairing the function of the leaf-spring.

(3) Another object of the present invention is to provide an article pushing device as mentioned above in item (1) or (2), which is characterized in that the upper bent portions have notches each of which has a two-stepped form consisting of an open-slit and a sliding-hole and can be easily fitted through the open-slit onto an axis to be set (e.g., a hook bar body).

(4) Another object of the present invention is to provide an article pushing device as mentioned above in any one of items (1) to (3), which is characterized in that the zigzag leaf-spring can be compressed to its minimal length, aligning all zigzags almost tight and and parallel to each other and reserving the necessary self-restoring force for assuring a long stroke and maximal use of a space on an axis to be set.

(5) Another object of the present invention is to provide an article pushing device as mentioned above in any one of items (1) to (4), which is characterized in that the zigzag leaf-spring is provided at least at its one end with a pushing portion having an acting point on an article and being capable of concentrating its self-restoring force to the acting point on the article, realizing effective pushing forward the article.

(6) Another object of the present invention is to provide an article pushing device as mentioned above in any one of items (1) to (5), which is characterized in that the zigzag leaf-spring is provided with fixing means for stably fixing on an axis to be set (e.g., a hook bar), enabling the zigzag leaf-spring to generate its self-restoring force necessary for stably feeding the articles.

(7) Another object of the present invention is to provide an article pushing device as mentioned above in any one of items (1) to (6), which is characterized in that the the fixing means having a fitting portion with an opening aligned coaxially to notches made in the upper bent portions is formed integrally with the zigzag leaf-spring in order to easily fix the zigzag leaf-spring at any desired position on an axis to be set (e.g. , the hook bar).

PREFERRED EMBODIMENT OF THE INVENTION

Figure 1:
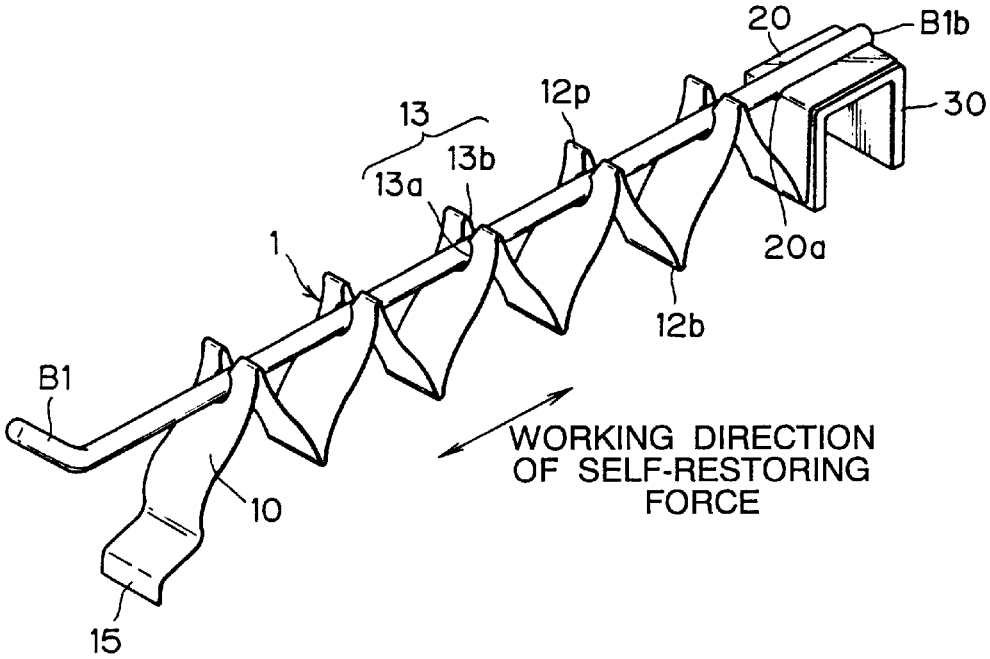
FIG. 1 is a perspective view of an article pushing device according to the present invention, which zigzag leaf-spring is fitted on a single hook bar.
Figure 2:
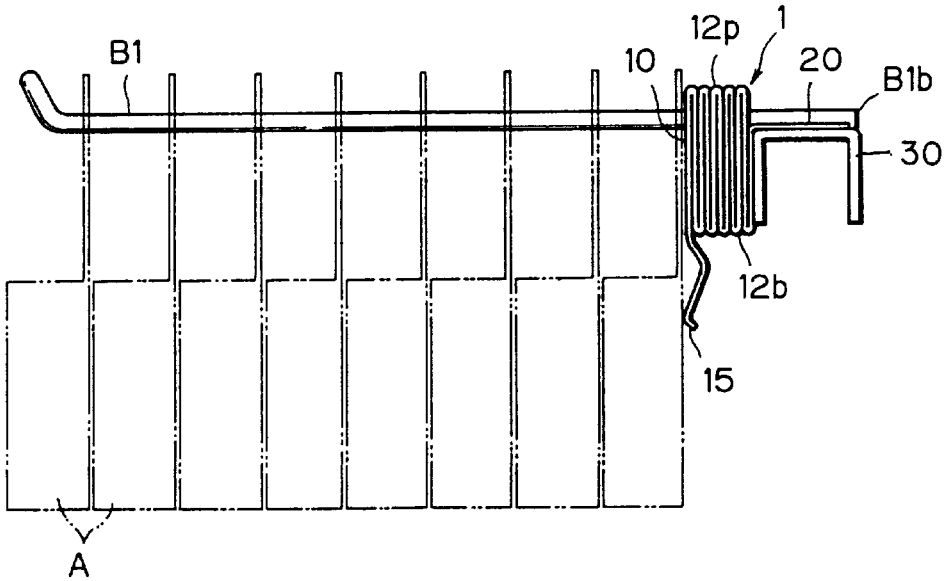
FIG. 2 is a side view of the article pushing device of FIG. 1, which is in its contracted state.

FIGS. 1 and 2 are views showing, in perspective and side view respectively, an article pushing device according to the present invention, which is fitted on a single hook bar B1.

This article pushing device comprises a zigzag leaf-spring 1 having a series of sharp alternate turns forming upper bents 12*p* and bottom bents 12*b*, which can be contracted to its minimal length with unit plate (leaf) portions 10 almost tightly faced in parallel to each other.

Figure 3B:
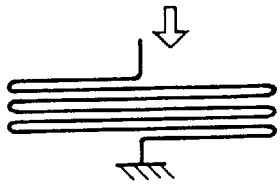
FIG. 3B is illustrative of a compressed-state zigzag leaf-spring of the article pushing device of FIG. 1.
Figure 3A:
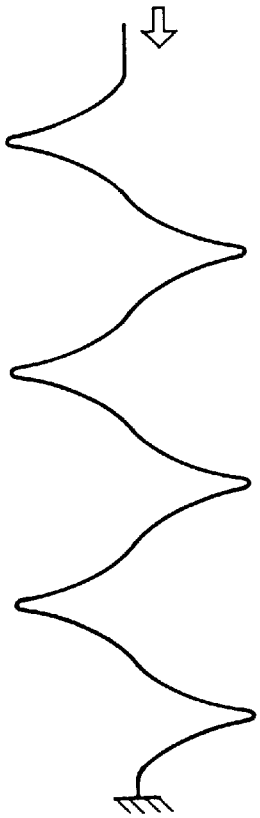
FIG. 3A is illustrative of a zigzag leaf-spring of the article pushing device of FIG. 1.
Figure 3C:
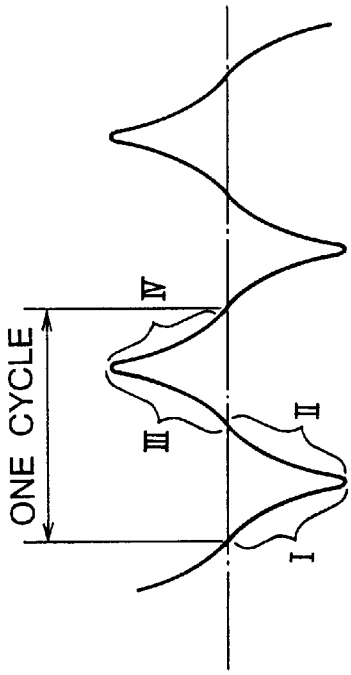
FIG. 3C is a view for explaining a zigzag leaf-spring of the article pushing device of FIG. 1.

In the shown embodiment, bent portions 12*p* and 12*b* being thicker than plate portions 10 between bent portions 12*p* and 12*b* so that they can be pinched strongly by fingers with no fear of changing in the spring force. In this embodiment, the zigzag leaf-spring has plate portions 10 which have not flat but curved surfaces (to be described bellow in detail) as shown in FIG. 3A and have a profile shown in FIG. 3C. It can be contracted as shown in FIG. 3B by squeezing at both ends. The shape of each plate portion 10 of the zigzag leaf-spring 1 of FIG. 1 is determined on the basis of the above-mentioned design principle. The shapes of elements (I)–(IV) composing one cycle may be defined according to following respective functional equations (I)–(IV).

[Mathematical Expressions]

$$y = \frac{10x}{\sqrt{144.0163366 - x^2}} \qquad (0.4 \leqq x \leqq 10) \quad \text{(I)}$$

$$y = \frac{10(20 - x)}{\sqrt{144.0163366 - (20 - x)^2}} \qquad (10.4 \leqq x \leqq 20) \quad \text{(II)}$$

-continued $$-y = \frac{10(x - 20)}{\sqrt{144.0163366 - (x - 20)^2}} \qquad (20 \leqq x \leqq 29.4) \quad \text{(III)}$$

$$-y = \frac{10(40 - x)}{\sqrt{144.0163366 - (40 - x)^2}} \qquad (30.4 \leqq x \leqq 40) \quad \text{(IV)}$$

The equations are shown by way of example and other approximate expressions may be applied for determining similar curved surfaces.

The upper bents 12*p* of the zigzag leaf-spring 1 have the same notches 13 made therein in the main axial working direction of self-restoring force produced in the leaf-spring. Each notch is formed of a sliding hole 13*a* with an open slit 13*b*. The zigzag leaf-spring 1 is fitted at notches 13 on a hook bar B1 by using the open slits 13*b* and is slidable along the hook bar by using sliding holes 13*a*.

The zigzag leaf-spring 1 has a pushing portion 15 formed at its front end, which pushing portion 15 is protruding forward beyond a bottom bent 12*b* to push a thicker portion (the center of gravity) of the last of articles A aligned in line on the hook bar B1. Thus, the articles A can be smoothly forwarded as the zigzag leaf-spring 1 expands.

The zigzag leaf-spring body is provided at its rear end with a holding plate 20 which is firmly fitted in its slot 20*a* on a rear end of the hook bar B1 to firmly hold the zigzag leaf-spring body on the hook bar B1.

The shown embodiment can be removed at the openings 13*b* of the notches 13 from the hook bar B1 without taking off the articles. It can be fitted again on the hook bar with the hanging articles.

When a large number of articles A are hung from the hook bar, the zigzag leaf-spring 1 is tightly contracted to its minimal length as shown in FIG. 2. In this case, the front pushing portion 15 is located below the compressed zigzag leaf-spring body 1, pushing thicker portion of the last article A. When a leading article is removed from the hook bar B, the array of the articles is smoothly fed forward until a new leading article occupies the vacant front space on the hook bar B1.

Figure 4:
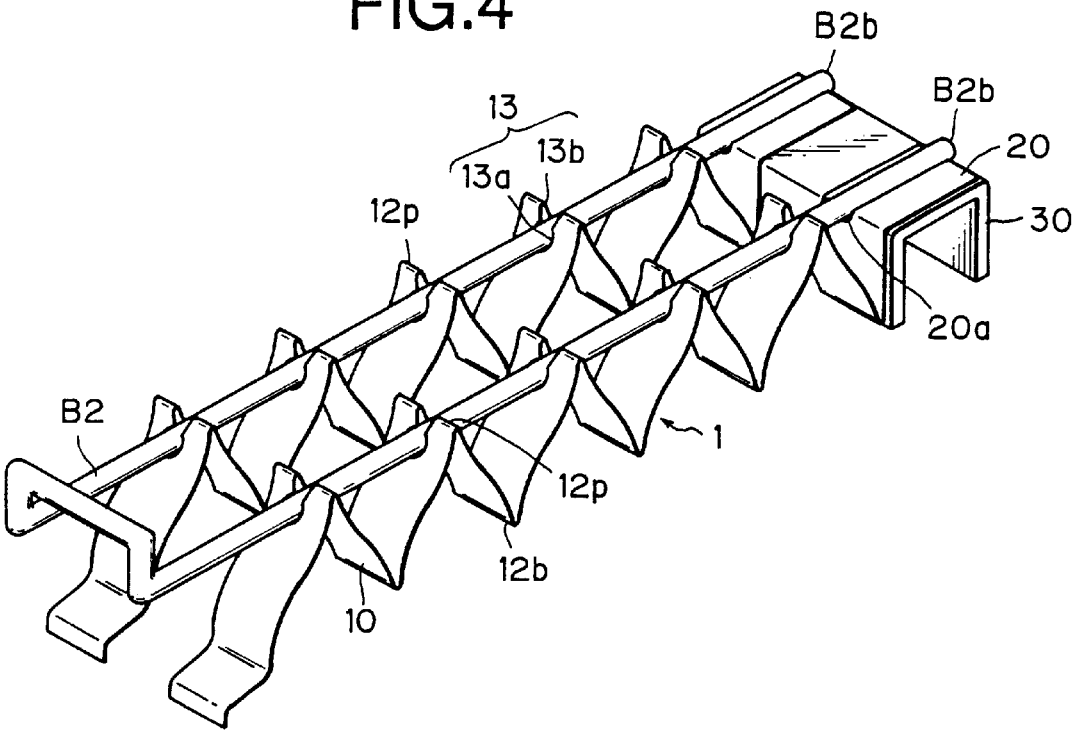
FIG. 4 is a perspective view of the article pushing device of FIG. 1, which zigzag leaf-spring body is fitted on double hook bars.

Referring to FIG. 4, another embodiment of the present invention is described as follows:

The shown embodiment is composed of two sets of articles-array pushing devices which are similar in shape to the pushing device of FIG. 1 and are fitted on a double hook bar B2. In FIG. 4, components similar to those shown in FIG. 1 are given the same numerals.

In this embodiment, two zigzag leaf-springs each of which has a series of notches 13 made in upper bents and fitted on one branch of the double hook bar B2 by using openings 13*b* of notches 13. Thus, the article pushing devices are commonly usable on a single hook bar and a double hook bar.

The article pushing devices of FIG. 4 are also firmly fitted at holding plates 20 on the both ends B2*b* of the double hook bar.

Figure 5:
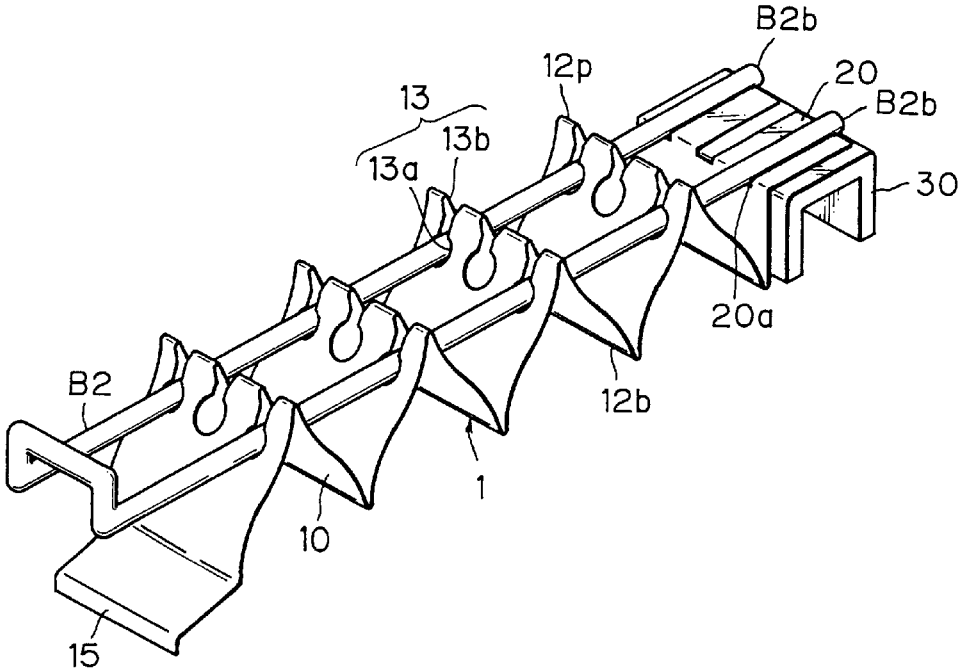
FIG. 5 is a perspective view of an article pushing device according to the present invention, which can be commonly used on a single-hook bar and a double-hook bar and which is now fitted on a double-hook bar.

Referring to FIG. 5, another embodiment of the present invention is described as follows:

In this embodiment, two sets of article pushing devices of FIG. 4 are formed into a single wide unit. Namely, the wide zigzag leaf-spring body has a plurality of lines (three lines in the shown case) of notches made in peaks thereof. This device can be fitted on a single hook bar (not shown) by using a central line of notches.

Figure 6:
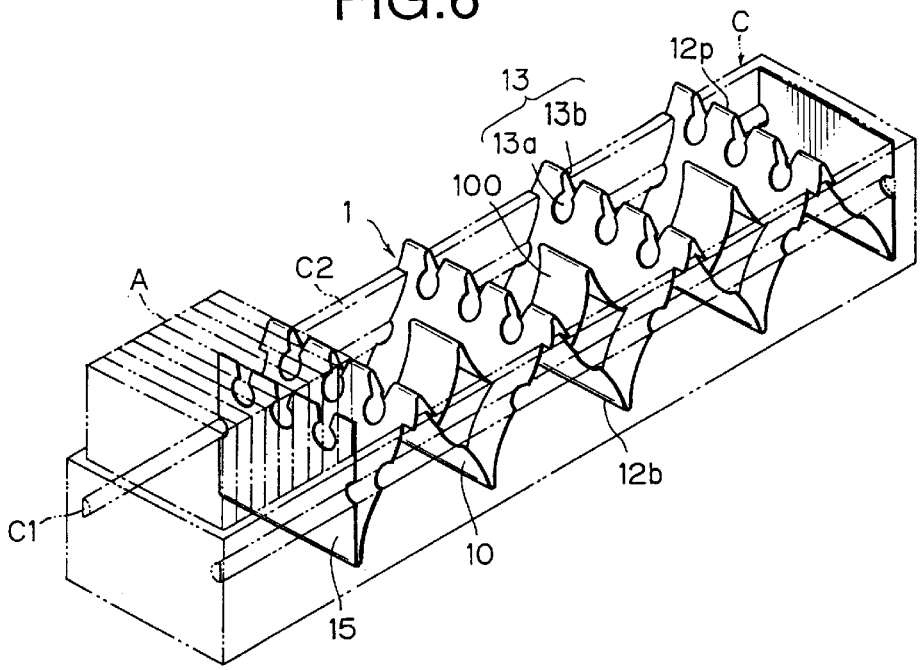
FIG. 6 is a perspective view of an article pushing device of FIG. 5, which is an embodiment adapted to use in a show case.

A further embodiment of the present invention is shown in FIG. 6. This embodiment is a case-mount type pushing device having a zigzag leaf-spring 1 adapted to use in a case C to push forward articles A, e.g., compact disks accommodated in line therein. The pushing device for use in the case C has guiding notches slidably fitting on line protrusions C1 formed on inner side walls of the case C and guiding notches slidably fitting on upper edges C2 of the case C as shown in FIG. 6.

In the shown embodiment, the zigzag leaf-spring 1 which can be contracted to its minimal length at which a series of plate sections defined by alternate turns (i.e., a peak 12*p* and a bottom 12*b*) are aligned in parallel to and substantially overlaid on each other. The device is also provided with a series of pose-control means 100 formed on respective bottoms 12*b*. Thus, the zigzag leaf-spring 1 with a change in the load thereon can smoothly move, pushing by its front pushing end 15 an array of articles in the case C. The pose-control means 100 are so designed to add a minimal loss in spacing in the zigzag leaf-spring when the latter is contracted.

As shown in FIG. 6, this embodiment has a plurality of rows of successive notches 13 for slidably fitting onto a double or single hook bar. In this instance, a series of notches formed therein are similar in construction to those of the before-described hunger-mount type pushing devices.

FIGS. 7 to 12 show different means of fixing the zigzag leaf-spring of an article pushing device to a hook bar or the like.

In the foregoing embodiments, the zigzag leaf-spring is fixed by firmly fitting its end holding portion onto the hook bar end-portion or by abutting at its end to the inner rear wall of the case. In this instance, the pushing device may be fixed at any desired position of a hook bar in the axial and radial directions thereof.

The zigzag leaf-spring itself is similar to those of the foregoing embodiments and, therefore, its components similar to those of the foregoing leaf-springs are given the same numerals in FIGS. 7 to 12.

Although article pushing devices of FIGS. 7 to 12 are fitted each for example on a single-hook bar and use zigzag leaf-springs similar to those shown in FIGS. 1, 2, 3A, 3B and 3C, they are not limited to the shown examples and may be modified for use on different display tools by using different leaf-springs.

Figure 7:
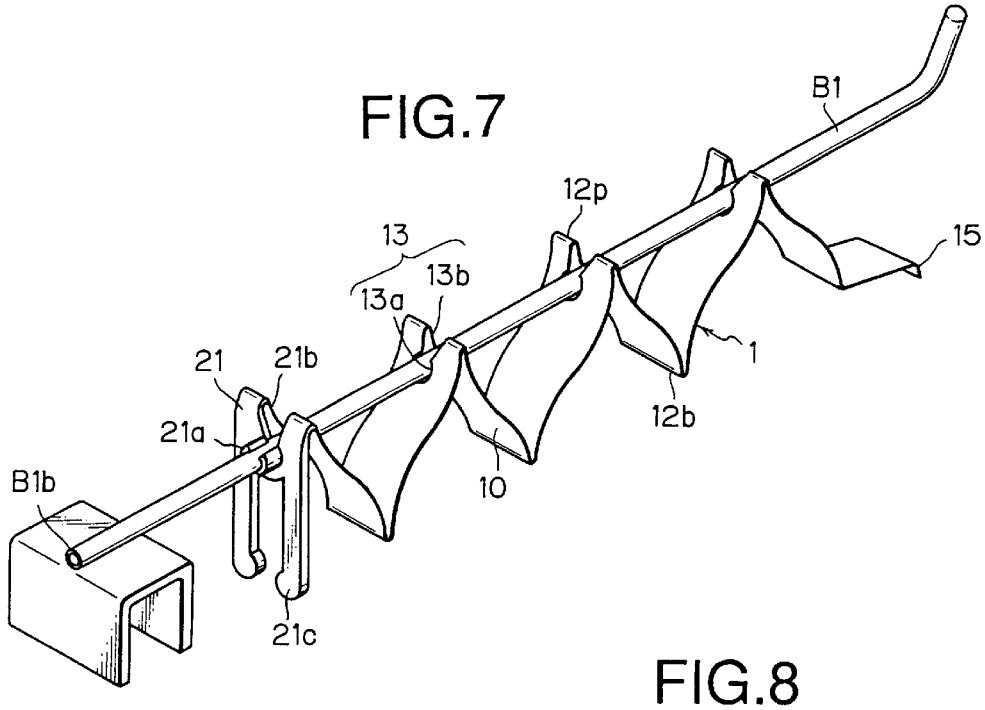
FIG. 7 is a perspective view of an article pushing device provided with a holding portion, which is an embodiment of the present invention.
Figure 8:
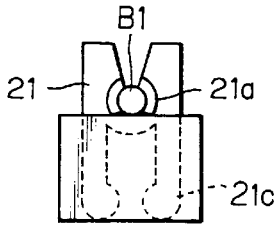
FIG. 8 is a rear view of the article pushing device of FIG. 7.

In FIGS. 7 and 8, the zigzag leaf-spring 1 consisting of a series of leaf-portions 10 with sharp alternate turns is provided with a holding portion 21 formed at the rear end of leaf-portion 10. The zigzag leaf-spring 1 is slidably fitted at series of notches 13 made in peaks of the leaf-portions and firmly fixed at its holding portion 21 onto the hook bar B1. The holding portion 21 has a nip-fitting opening whose axis coincides with through axis of sliding holes 13*a* of the respective notches 13. As compared with the leaf-portions 10, the holding portion 21 has a thicker portion and can catch the body of the hook bar with a suitable gripping force allowing manual displacement of it along the hook bar B1. The holding portion 21 may be provided with a cylindrical part 21*a* in the axial direction in order to obtain a larger gripping force. Similarly to the notches of the zigzag leaf-spring, this holding portion also has an open slit 21*b* allowing easy fitting of the portion on the hook bar B1.

To prevent the holding portion 21 from voluntarily moving on the hook bar by the effect of a small external force, it is effective to increase a griping force of the holding portion 21 by providing the above-mentioned cylindrical part 21*a* or the like means. This may, however, make it difficult to mount and displace the pushing device on the hook bar B1.

To solve the above-mentioned problem, the embodiment shown in FIGS. 7 and 8 is provided with a removing portion. As shown in FIG. 7 and FIG. 8 showing a rear side view of FIG. 7, the removing portion 21*c* (of clipper type) is a pair of legs elongating downward from the holding portion 21. An upper opening 21*b* of the holding portion 21 can be widened (i.e., the grasping force is weakened) by compressing by fingers the two legs of the removing portion 21*c*.

Figure 9:
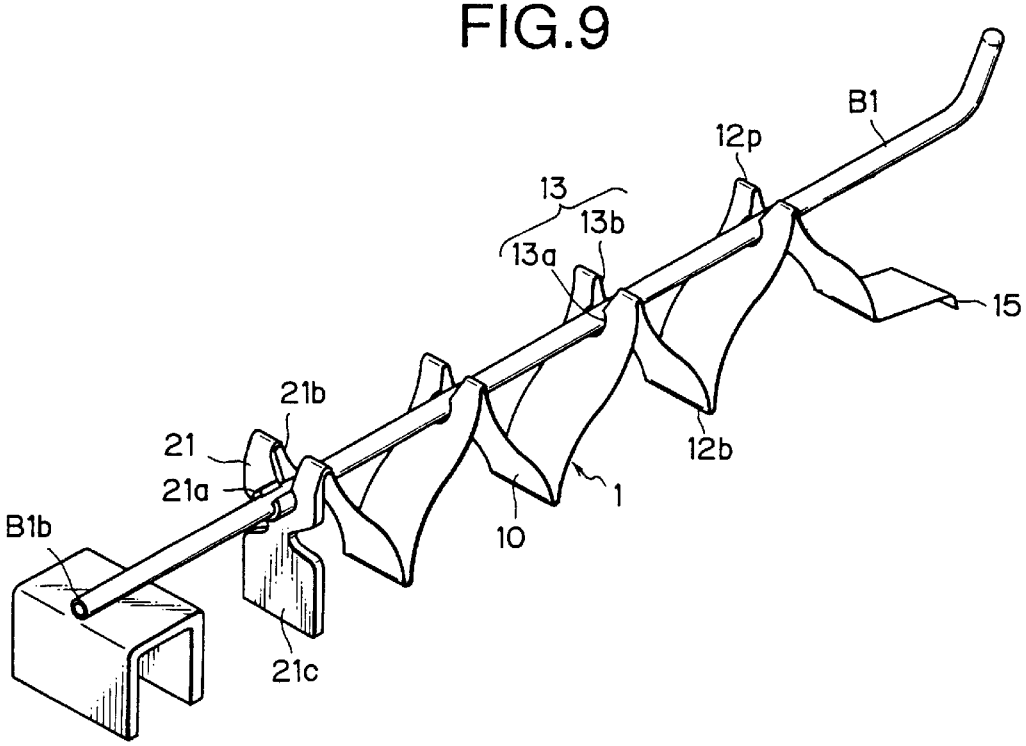
FIG. 9 is a perspective view of the article pushing device of FIG. 7, which is provided with a different holding portion at its one end.
Figure 10:
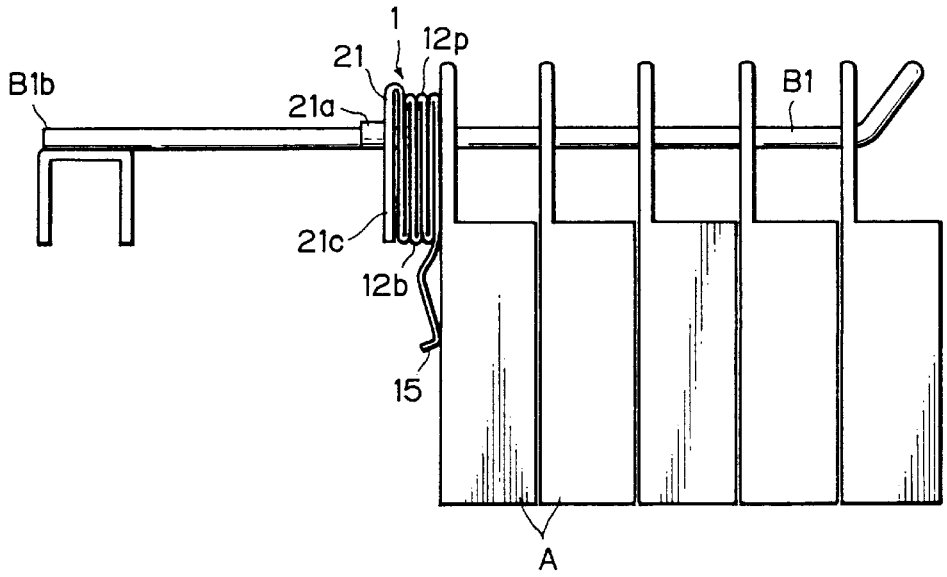
FIG. 10 is a side view of the article pushing device of FIG. 7, which is in working state.

Another removing portion 21*c* shown in FIG. 9 is a plate elongating downward from a holding portion 21. An opening of the holding portion 21 can be widened by pressing the plate of removing portion 21*c* (by the action of leverage) making the holding portion 21 be easily detached from the hook bar B1.

The provision of the removing portion 21*c* together with the holding portion 21 makes it possible to attach the article pushing device to any desired portion (except the both ends) of the hook bar B1. Therefore, the pushing force of the device can be suitably adjusted in accordance to the quantity and mass of feedable articles A by adjusting the position of the holding portion 21 on the hook bar B1.

Figure 11:
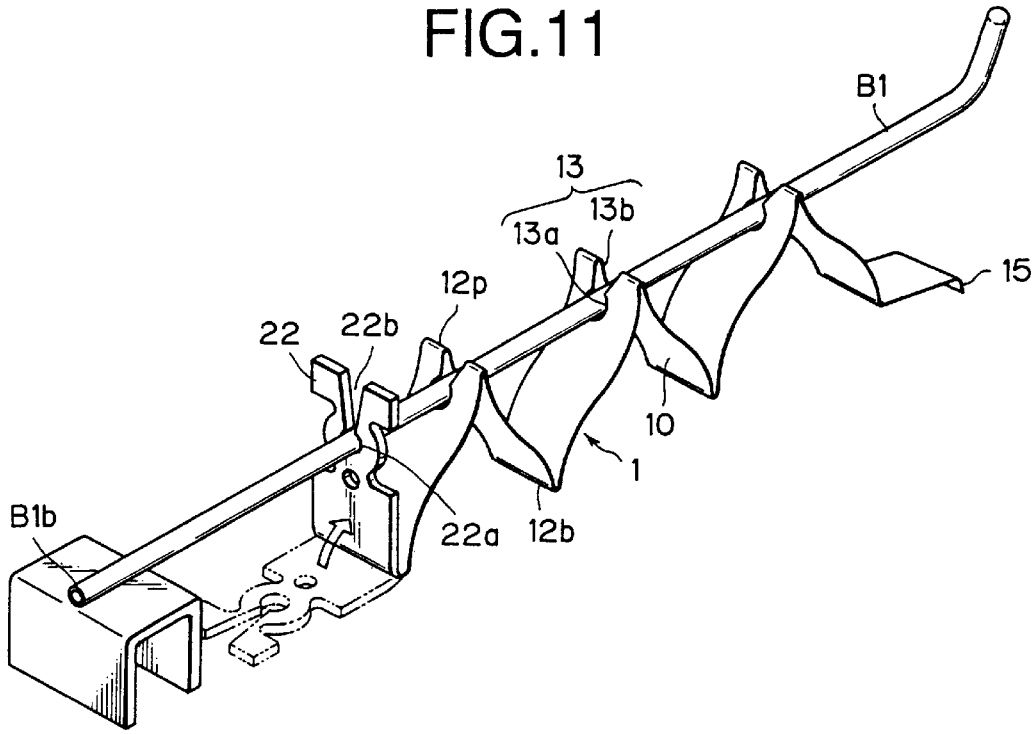
FIG. 11 is a perspective view of an article pushing device according to the present invention, which is provided with a holding portion that can be turned up and down.
Figure 12:
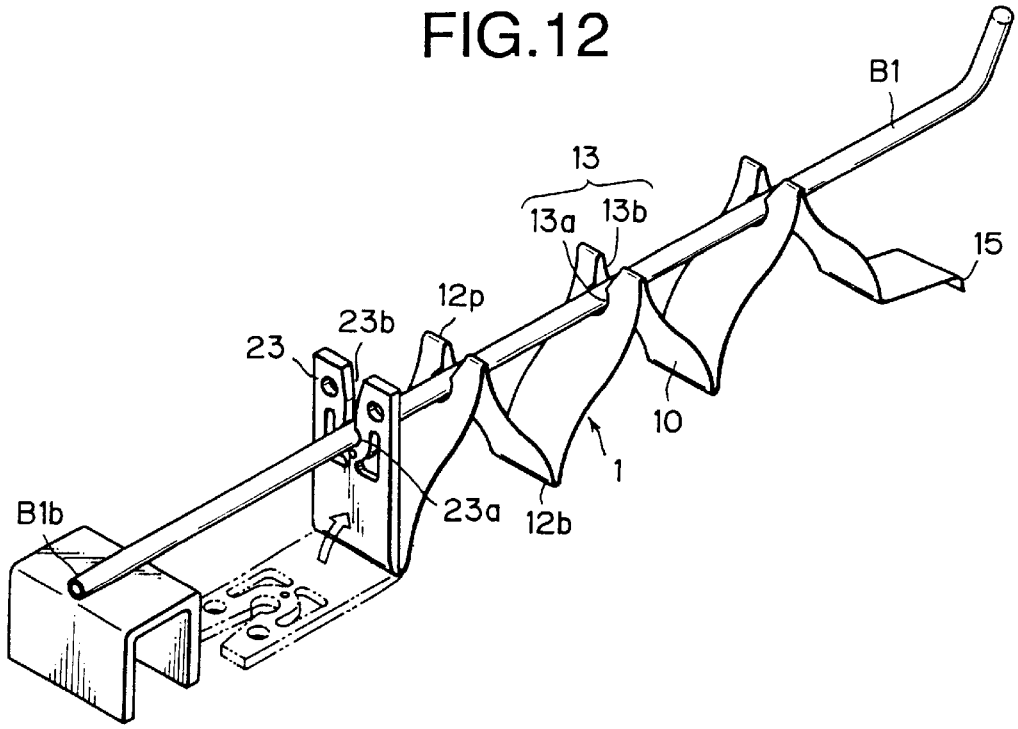
FIG. 12 is a perspective view of another article pushing device according to the present invention, which is provided with another holding portion that can be turned up and down.

Different types of holding members are shown in FIGS. 11 and 12. Each of the holding members is jointed to the last leaf-portion of a zigzag leaf-springs.

In FIG. 11, the holding member 22 is so formed to grasp a hook bar body in its holding portion 22*a* by the action of its elasticity. In this instance, the holding portion 22 is connected integrally with the rear end leaf-portion composing the zigzag leaf-spring and it can be turned from the horizontal position to the vertical position and vice versa as shown in FIG. 11. The connection of the holding member 22 with the leaf-portion of the zigzag spring is made not to cause the deformation of the leaf-portion by repeated turning movements of the former. The shape of the holding member 22 is designed with due consideration that it can be easily fitted on the hook bar B1 and can stably hold the pushing device on the hook bar B1.

Thus, the pushing device with holding element 22 can be easily mounted on the hook bar B1 first by fitting the zigzag leaf-spring thereon by using notches made in peaks of leaf-portions and finally by inserting the hook bar body through an opening 22*b* into the holding portion 22*a* of the holding member 22 in vertical position.

The holding member 23 shown in FIG. 12 is similar in function to the holding member of FIG. 11 and differs in shape from the latter. In this case, the holding member 23 is fitted on a hook bar B1 by inserting the hook bar body into a gripping portion 23*b* of the holding member 23 through an opening 23*b*.

Although all fixing means shown in FIGS. 7 to 12 are designed as holding portions formed integrally with the zigzag leaf-springs to be mounted on the hook bars, they may be made as individual fixing parts separated from the zigzag leaf-springs, which may serve as stoppers for the zigzag leaf-springs.

Figure 13:
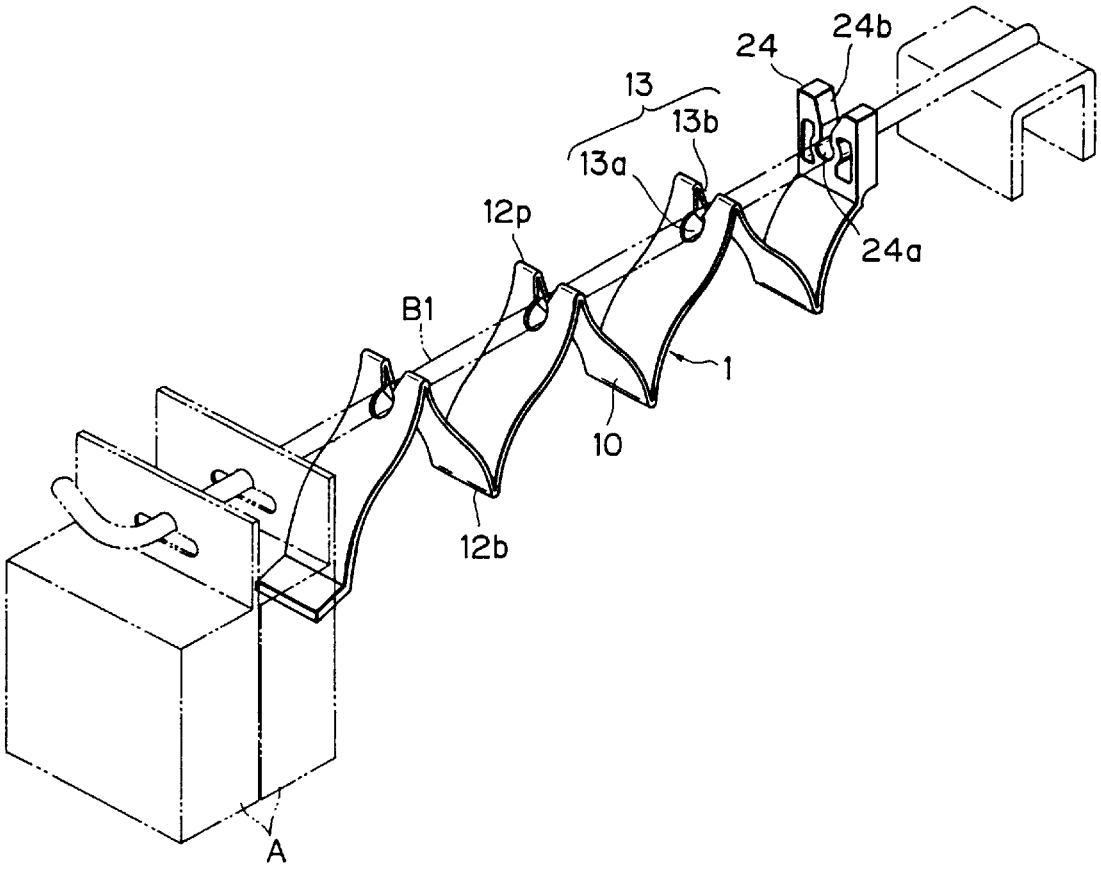
FIG. 13 is a perspective view of another article pushing device embodying the present invention, which body is composed of a zigzag leaf-spring.

Referring to FIG. 13, another embodiment of the present invention is described as follows:

In FIG. 13, a zigzag leaf-spring 1 composed of a large number of unit leaf-portions 10 which forms a wave-like pattern (FIG. 3A) with notches 13 made in successive upper bents 12*p*. Each notch 13 consists of a sliding hole 13*a* with an opening 13*b*. The zigzag leaf-spring is slidably fitted at the notches 13 on a single hook bar B1 (in case of FIG. 13).

The zigzag leaf-spring 1 also has a series of bottoms 12*b* with a front-end pushing portion 15 pressing the rearmost one of articles A hanging from the hook bar B1.

In this embodiment, the zigzag leaf-spring 1 has a thick-walled holding member 24 jointed integrally with the rear end thereof at a half level between the peak 12*p* and the bottom 12*b*. This holding member 15 has a holding portion 24*a* and an opening portion 24*b* made in its top. The zigzag leaf-spring 1 can be easily mounted on the hook bar B1 by using the notches in the peaks of zigzags and in the holding portion. Thus, the zigzag leaf-spring 1 of FIG. 13 is reliably held at its rear end by the holding member 24 firmly fixed onto the hook bar B1, eliminating the possibility of undesirable vertical vibration or axial displacement of the rear-end portion of the leaf-spring 1 on the hook bar B1 when the latter contracts or expands. The holding member 24 can be easily moved by hand along the hook bar B1. Accordingly, it is possible to adjust the working stroke and the pushing force of the zigzag leaf-spring 1 for forwarding the articles A by manually changing the position of the holding member 24 on the hook bar B1.

Figure 14:
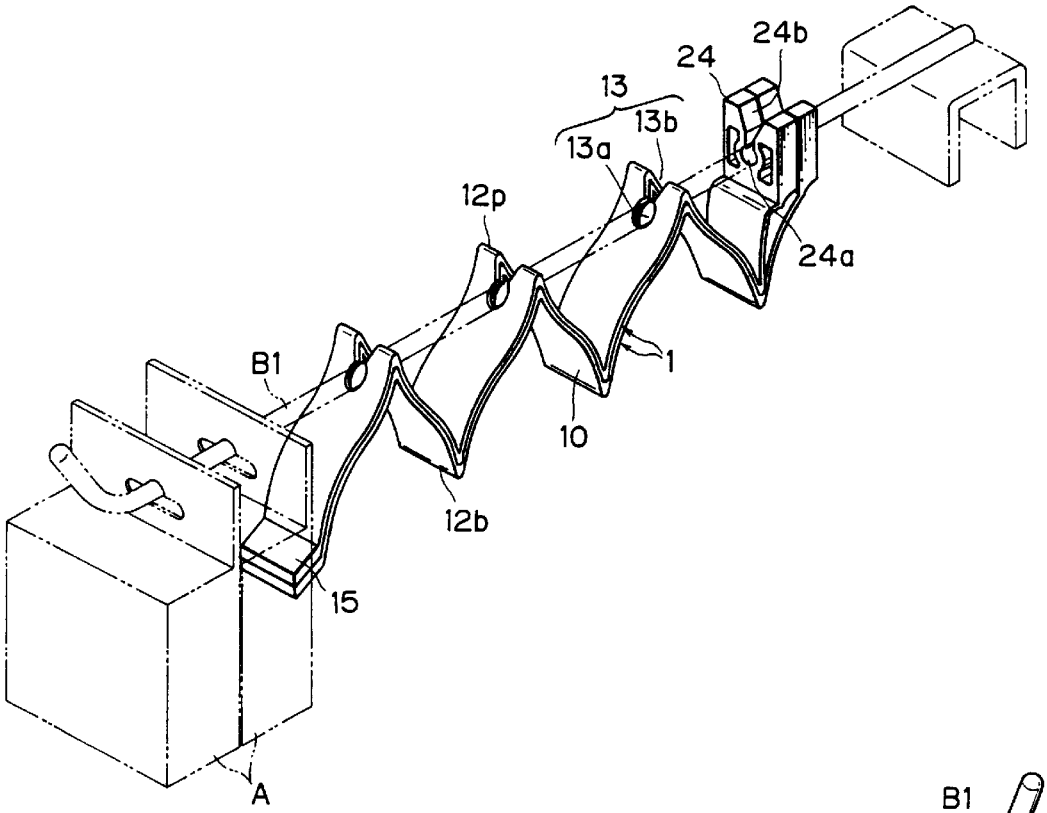
FIG. 14 is a view showing two article pushing devices embodying the present invention, which zigzag bent leaf-springs are laid over each other.

FIG. 14 shows an example of using two pushing devices overlaid on each other.

There may be such a case that articles A are so heavy not to be fed forward along a hook bar B1 by a single pushing device. In this instance, two sets of pushing devices are applied as laid on each other as shown in FIG. 14. The shown pushing devices have the same patterns each consisting of series of the same shape alternate turns 12*p* (peaks) and 12*b* (bottoms). Consequently, the two pushing devices can well fit to each other to form a single-piece double-layer pushing device that is easy to mount and adjust on the hook bar B1. The double-layer pushing device (two zigzag leaf-springs 1) is held by two holding members 24 which hold the hook bar B1 with a doubled holding force as compared with a single pushing device.

Figure 15:
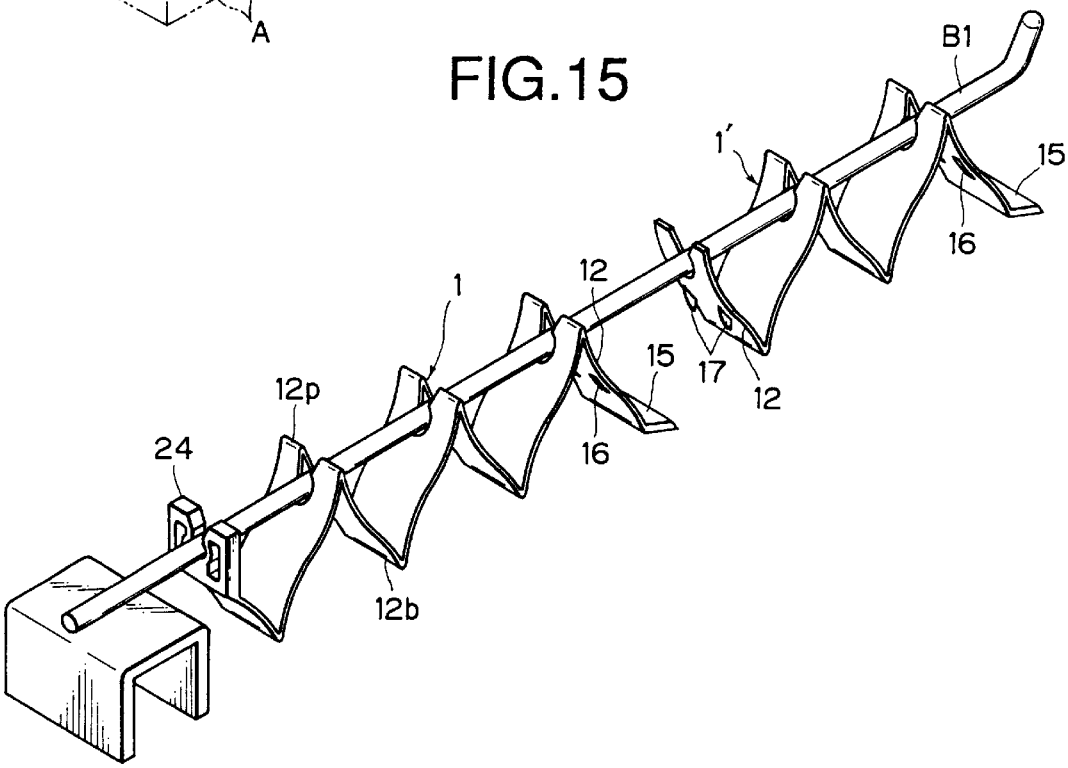
FIG. 15 is a view of an article pushing device having jointing means according to the present invention.

FIG. 15 shows an example of using two pushing devices jointed with each other in series on a hook bar.

Two pushing devices are jointed together in series for pushing the articles on the hook bar in case if the necessary working stroke can not be obtained by one pushing device. Namely, a base zigzag leaf-spring 1 has two hooking holes 16 made in its front leaf-end 12 and a zigzag leaf-spring 1' has two hooks 17 formed at its rear leaf-end 12. Two pushing device are jointed together by engaging the hooks 17 of the additional spring 1' in the respective hooking holes 16 of the base spring 1. These two zigzag leaf-springs 1, 1' can smoothly move as a single-piece that can contract and expand without disengagement of the hook joints. Two pushing devices can be separated from each other by pushing down the pushing portion 15 by a finger.

Components of the pushing devices according to the present invention may be preferably made of plastics or laminated plastics that may be well-slidable on a hook bar with no noise.

The zigzag leaf-spring 1 and the members formed integrally with the leaf-spring 1 are preferably made of plastics (e.g., POM resin) but may be made of other material, e.g., metal.

The zigzag leaf-spring may be somewhat uneven in size, thickness and width of its peaks 12*p* and the bottoms 12*b* but can be contracted to its minimal length at which its leaf surfaces are almost tight and parallel to each other (with a minimal space between neighboring leaf-portions).

It is also allowed to the peaks 12*p* and the bottoms 12*b* are protruded as shown in FIG. 3 and the zigzags may have gradually increasing or decreasing pitches and heights.

A series of notches made in a zigzag leaf-spring according to the present invention may be opened in any direction (up, down, left and right) and may be opened not only in the same direction but in different directions.

Although the embodiments described above are used, by way of example, mainly for pushing a line of articles hanging for sale from a hook bar, the present invention is directed to provide the pushing devices which can be used for pushing forward an array of any kind of articles or materials for sale, display or other purpose, which are hanging from the hook bar or accommodated in an open case and preferably placed within easy reach of users and customers.

As apparent from the foregoing, the present invention provides:

(1) an article pushing device which has notches made in upper bents of a zigzag leaf-spring body to be externally and slidably fitted at the notches on a hook bar without taking off articles hanging therefrom or has notches made in upper bents of the zigzag leaf-spring body to mount on two or more kinds of hook bars, assuring easy use and wide application; which has coupling means formed at both ends and can be extended by jointing an additional pushing device or devices thereto for use on a long hook bar; which can be manufactured easily at a low cost; and which has thick-walled bent portions tough enough not be deformed by compressed by fingers and not to cause decrease the spring force;

(2) an article pushing device which has advantages described in item (1) and is further characterized in that the zigzag leaf-spring can be contracted to its minimal length at which all leaf-portions are almost tight and parallel to each other (with a minimal space between neighboring leaf-portions), assuring the maximal mounting of articles on a hook bar or in a case;

(3) an article pushing device which has advantages described above in items (1) and (2) and is further characterized in that the zigzag bent leaf-spring is provided with a pushing portion that effectively applying its self-restoring force to an article and provided with pose-control portions to stabilizing the movement of the zigzag leaf-spring and thereby realizing smooth feeding of articles;

(4) an article pushing device which has advantages described above in items (1) and (3) and is further characterized in that it is provided fixing means for fixing the zigzag leaf-spring at any desired position in axial directions and/or radial directions on a hook bar and which fixing means has fitting portion with an opening aligned coaxially to notches made in the leaf-portions and is formed integrally with the zigzag leaf-spring; the device is easy to manufacture at a low cost and easy to mount on the hook bar; the pushing force of the device can be suitably adjusted in accordance to the number and mass of feedable articles by adjusting the position of the holding portion on the hook bar.

What is claimed is:

1. An article pushing device comprising a zigzag leaf-spring body being able to be compressed to its minimal length aligning all leaf-portions almost tight and parallel to each other and reserving a necessary self-restoring force, having a series of notches in the axial acting direction of self-restoring force produced in the zigzag leaf-spring body and being slidably fittable at the notches onto an axis to be set.

2. An article pushing device comprising a zigzag leaf-spring body being compressed to its minimal length aligning all leaf-portions almost tight and parallel to each other and reserving a necessary self-restoring force, having at least one series of notches made in bent portions thereof in the axial acting direction of self-restoring force produced in the zigzag leaf-spring body and being slidably fittable at the notches onto an axis to be set, wherein each of the series of notches consists of an open slit portion and a sliding hole portion for easily fittable onto the axis to be set by using the open slit portion.

3. An article pushing device as defined in claim 1 or 2, wherein the zigzag leaf-spring body is provided at least at its one end with a pushing portion having an acting point on an article and being capable of shifting an effective acting position of self-restoring force of the leaf-spring to the acting point on the article for effectively pushing forward the article.

4. An article pushing device as defined in claim 1 or 2, wherein the zigzag leaf-spring body is provided with fixing means for fixing the body to the axis to be set.

5. An article pushing device as defined in claim 1 or 2, wherein the zigzag leaf-spring body is provided with fixing means having a fitting portion with an opening aligned coaxially to notches made in the bent portions for fixing the body to the axis to be set and being formed integrally with the zigzag leaf-spring body.

* * * * *